US009756920B2

(12) United States Patent
Spears

(10) Patent No.: US 9,756,920 B2
(45) Date of Patent: Sep. 12, 2017

(54) BACKPACK WITH REMOVABLE STRAPS AND ADJUSTABLE BELTS

(71) Applicant: Candace Spears, Roseburg, OR (US)

(72) Inventor: Candace Spears, Roseburg, OR (US)

( * ) Notice: Subject to any disclaimer, the term of this patent is extended or adjusted under 35 U.S.C. 154(b) by 34 days.

(21) Appl. No.: 15/061,097

(22) Filed: Mar. 4, 2016

(65) Prior Publication Data

US 2016/0286939 A1 Oct. 6, 2016

Related U.S. Application Data

(60) Provisional application No. 62/141,137, filed on Mar. 31, 2015.

(51) Int. Cl.

*A45F 3/04* (2006.01)
*A45F 3/08* (2006.01)
*A45C 13/30* (2006.01)

(52) U.S. Cl.

CPC ..... *A45C 13/30* (2013.01); *A45F 3/04* (2013.01); *A45F 3/047* (2013.01); *A45C 2013/306* (2013.01); *A45F 3/08* (2013.01); *A45F 2003/045* (2013.01)

(58) Field of Classification Search

CPC ..... A45F 3/08; A45F 3/04; A45F 2003/045; A45F 2003/144

USPC ..... 224/625, 626, 627, 637, 262, 631, 632, 224/660

See application file for complete search history.

(56) References Cited

U.S. PATENT DOCUMENTS 4,029,243 A * 6/1977 Zerobnick ..... A45F 3/00 224/664
4,307,826 A * 12/1981 Stewart ..... A45F 3/08 224/634
4,976,383 A * 12/1990 Norris ..... A45F 3/04 224/262
5,025,965 A * 6/1991 Smith ..... A45F 3/04 224/579
5,090,604 A * 2/1992 Howe ..... A45F 3/04 224/641
5,228,609 A * 7/1993 Gregory ..... A45F 3/02 224/617
5,487,498 A * 1/1996 Gleason ..... A45F 3/04 224/153
5,503,314 A * 4/1996 Fiscus ..... A45F 3/08 224/262
5,529,230 A * 6/1996 Smith ..... A45F 3/00 224/153
5,529,260 A 6/1996 Wirick
5,570,824 A * 11/1996 Lyon ..... A45F 3/00 224/148.5
5,586,699 A * 12/1996 Heisler ..... A45F 3/08 224/259
5,617,984 A * 4/1997 Fabel ..... A45F 3/04 224/641
5,702,042 A * 12/1997 Peacock ..... A45F 3/00 2/44
5,725,139 A 3/1998 Smith
(Continued)

*Primary Examiner* — Justin Larson
(74) *Attorney, Agent, or Firm* — Mohr Intellectual Property Law Solutions, PC

(57) ABSTRACT

Backpacks, including shoulder strapless backpacks. In some examples, the backpack includes adjustable removable shoulder straps. In some further examples, the backpack includes adjustable hip, torso, and chest straps.

19 Claims, 9 Drawing Sheets

(56) References Cited

U.S. PATENT DOCUMENTS

| | | | | | |
|---|---|---|---|---|---|
| 5,762,243 | A * | 6/1998 | McMaster | A45F 3/08 | 224/262 |
| 5,984,157 | A * | 11/1999 | Swetish | A45F 3/10 | 224/631 |
| 6,824,030 | B1 * | 11/2004 | Dolan | A45F 3/04 | 224/638 |
| 6,857,820 | B2 * | 2/2005 | Jacoway | B63C 11/02 | 224/627 |
| 7,021,508 | B1 * | 4/2006 | Aston | A45F 3/00 | 224/628 |
| D543,025 | S * | 5/2007 | Cicione | D3/224 | |
| 7,287,677 | B2 * | 10/2007 | Reid | A45F 3/047 | 224/628 |
| 7,757,911 | B2 * | 7/2010 | Barker | A45C 3/14 | 224/153 |
| 7,757,912 | B1 * | 7/2010 | Fabro | A45F 4/02 | 224/153 |
| 8,381,956 | B2 * | 2/2013 | Gleason, Jr. | A45F 3/08 | 224/635 |
| 9,044,081 | B2 * | 6/2015 | McDonald | A45F 3/14 | |
| 2005/0184118 | A1 * | 8/2005 | Vella | A45F 3/02 | 224/625 |
| 2013/0175310 | A1 * | 7/2013 | Turner | A45F 3/04 | 224/637 |
| 2014/0151424 | A1 * | 6/2014 | Hexels | A45F 3/06 | 224/637 |
| 2016/0286939 | A1 * | 10/2016 | Spears | A45C 13/30 | |

* cited by examiner

BACKPACK WITH REMOVABLE STRAPS AND ADJUSTABLE BELTS

CROSS REFERENCE TO RELATED APPLICATIONS

This application claims priority to U.S. Application, Ser. No. 62/141,137, filed on Mar. 31, 2015, which is hereby incorporated by reference for all purposes.

BACKGROUND

The present disclosure relates generally to backpacks with removable straps and adjustable belts. In particular, backpacks that include hip and torso laterally extendable belts for attachment to a user's body are described.

Backpacks are worn by users for transport and storage of items (e.g., clothing, books, groceries, camping equipment, sports equipment, etc.). In particular, backpacks are often used for transport of heavy items (i.e., a heavy load) because of a limited capacity to carry heavy weights for long periods of time with the hands. Conventional backpacks generally include a main pouch with additional smaller attached pouches or pockets. A pair of shoulder straps extend from a top of the main pouch to the bottom of the main pouch and are configured for each strap to contact and be supported by a shoulder of the user. Thus, the user's shoulders bear the weight of the load in the backpack. In some cases, backpacks include a supplemental hip belt or chest strap to support or transfer a portion of the weight of the load in the backpack away from the shoulders.

Known backpacks are not entirely satisfactory for the range of applications in which they are employed. For example, existing backpacks can cause stress fractures in the back, inflammation of cartilage, back and neck strain, nerve damage in the neck and shoulders, unnatural spinal compression, poor posture (e.g., hunching or leaning forward), and other health and postural damage. This damage can be especially prominent in children carrying heavy loads of books while their bodies are still undergoing growth and development. In some cases, carrying of heavy loads in backpacks can cause permanent neck, spine, and/or shoulder damage. According to the U.S. Customer Product Safety Commission, more than 28,000 people were treated for backpack-related injuries in the United States in 2012. That figure included 8,500 children between the ages of 5 and 18 who were treated in doctors offices and emergency rooms. The cost—in medical bills, lost wages, pain and suffering, and legal liability—is more than $1 billion annually.

In addition, conventional backpacks cannot be worn by users with chronic neck, spinal, and/or shoulder injuries and conditions. Often users with chronic neck, spinal, and/or shoulder injuries and conditions are unable to bear not only heavy loads, but even light loads on their shoulders. In some cases, users can wear a hip pack, however, hip packs provide only a small amount of carrying space and transfer the entire weight of the pack to the users' hips. Accordingly, users with chronic injuries and conditions have limited ability to transport and/or carry items. Further, users with chronic injuries and conditions can be limited in their ability to participate in activities that require carrying of equipment, such as backpacking and hiking.

Thus, there exists a need for backpacks that improve upon and advance the design of known backpacks. Examples of new and useful backpacks relevant to the needs existing in the field are discussed below.

Disclosure addressing one or more of the identified existing needs is provided in the detailed description below. Examples of references relevant to backpacks include U.S. Patent References: U.S. Pat. No. 5,529,260 and U.S. Pat. No. 5,725,139. The complete disclosures of the above patents and patent applications are herein incorporated by reference for all purposes.

SUMMARY

The present disclosure is directed to backpacks, including shoulder strapless backpacks. In some examples, the backpack includes adjustable removable shoulder straps. In some further examples, the backpack includes adjustable hip, torso, and chest belts.

DETAILED DESCRIPTION

The disclosed backpacks with removable straps and adjustable belts will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, a variety of backpacks with removable straps and adjustable belts examples are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-19, a first and second example of a backpack with removable straps and adjustable belts, backpacks 100 and 200, will now be described. Backpacks 100 and 200 function to receive and retain objects in a bag space, allowing the user to carry the objects while walking, running, or otherwise travelling/moving. Additionally, or alternatively, backpacks 100 and 200 can be used to support the spine of a user during wear. In other words, the described backpacks mitigate the risk of injury and support "good posture" of a user during wear.

Backpacks 100 and 200 address many of the shortcomings existing with conventional backpacks and hip packs. For example, the described backpacks are ergonomic and limit and/or prevent spinal injury during transporting of objects (i.e., carrying of a load) in the backpacks. Further, the described backpacks allow a user to carry a relatively large load, as compared to conventional hip packs. Finally, the described backpacks are customizable according to the wearer's needs and unique body type.

Figure 1:
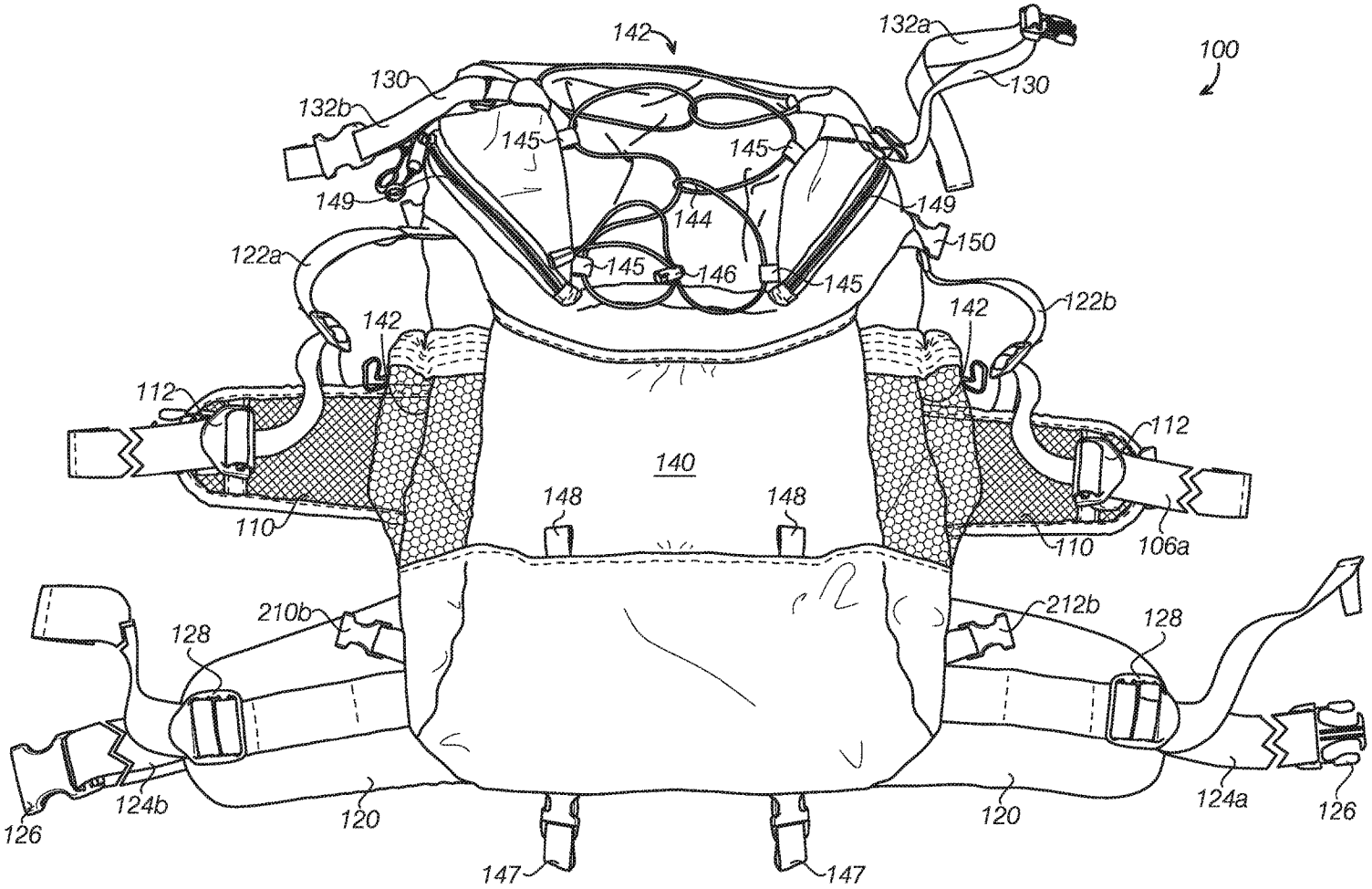
FIG. 1 is a front elevation view of a first example of a backpack with removable straps and adjustable belts.

As shown in FIG. 1, a front elevation view of backpack 100 shown. Backpack 100 includes a torso belt 110, a hip belt 120, a top belt 130, and a bag 140. Bag 140 defines a space configured to receive/store objects and comprises a single empty sp ace. In one specific example, bag 140 has the dimensions of 14"×11"×6" and is configured to carry a 25-35 lb. load, however it should be understood that in other examples, the bag can have any desired dimensions for carrying a larger or smaller load according to the user's needs. Thus, the dimensions of bag 140 may vary according the wearer's body type, e.g., a child wearing backpack 100 may utilize a smaller version of bag 140 than an adult. In alternative embodiments, bag 140 may comprise a plurality of dividers or other separators to enable compartmentalized storage, transport, and separation of items within bag. In a preferred embodiment, bag 140 comprises a flexible, lightweight textile such as nylon, polyester, leather, cotton, latex, polyurethane acrylic, PVC, or coated fabric, or any other material now known, or later discovered, to be suitable for the purpose of providing a protective surrounding for transportable items.

As can be seen in FIG. 1, bag 140 may comprise a plurality of specialized compartments 142 for storing items such as water bottles and the like. In alternative embodiments, compartment 142 may further comprise a retainer 144 for storing and transporting items outside of bag 140. In the present embodiment, compartment 142 is substantially net-like, however alternative configurations of compartment 142 e.g., pockets are contemplated. Further, retainer 144 comprises cording passed through a plurality of loop 145 to create a woven mesh that may be loosened or tightened via fastener 146. In the present figure, retainer 144 comprises elastic cording and fastener 146 comprises a cord lock. It should be understood that retainer 144 may be any suitable material a strand-like configuration and fastener 146 may be any fastener sufficient to allow tightening and loosening of cording 145. It should further be understood that retainer 144 may further comprise plastic cording, non-elastic fabric, twine, cable, or any other material that is capable of being woven into a net or mesh like configuration.

Figure 4:
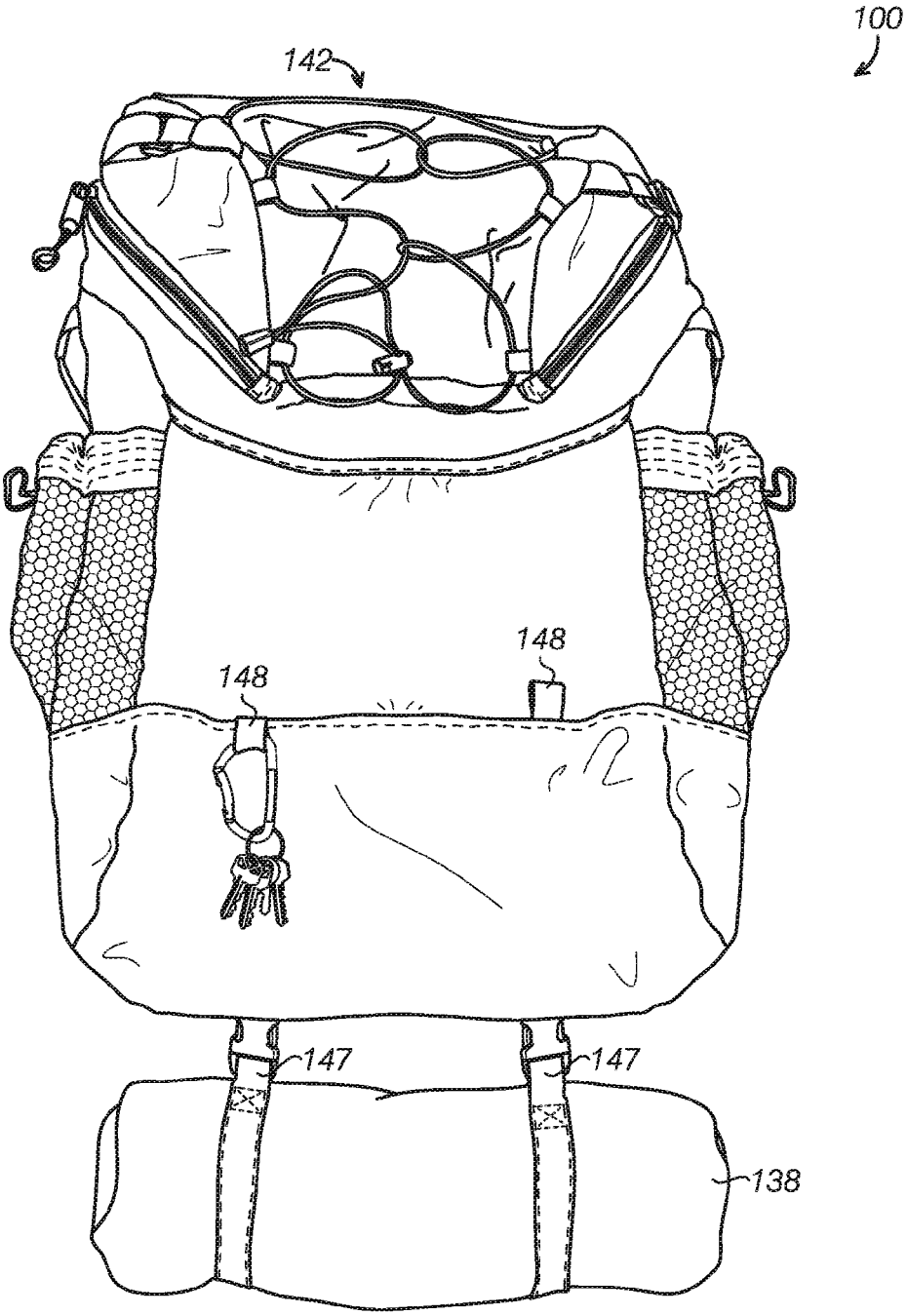
FIG. 4 is a front elevation view of a first example of a backpack with removable straps and adjustable belts depicting with connected straps according to an embodiment of the present invention.

Bag 140 may further comprise at least one expansion attachment 147 that is configured to removably couple to a complementary attachment for the purpose of attaching additional carrying components (shown and described in FIG. 4). In the present embodiment, expansion attachment 147 comprises the female end of a side release buckle, however it is an object of the present invention that expansion attachment 147 may comprise snaps, buckles, ties, hook-and-loop fasteners, or any coupling mechanism sufficient to accomplish attaching additional carrying components to bag 140. In alternative embodiments (shown and described in further detail below), bag 140 further comprises at least one removable shoulder strap 160 that may be attached to connector 150. In the present embodiment, connector 150 is a side release buckle, however it is an object of the present invention that connector 150 may be any kind of connecting means that is capable of removably receiving a complementary connector, e.g., a suitable coupling relationship.

Finally, bag 140 may also comprise a plurality of hoop 148 that may be employed to attach additional items to bag 140 via external attaching mechanisms such as carabiners, hooks, rings, and the like. In alternative embodiments (discussed in further detail below), bag 140 and/or compartment 142 may further comprise a plurality of zipper closure 149. As mentioned above, bag 140 further comprises a first pair of shoulder strap coupling means 210*a* and *b* and a second pair of shoulder strap coupling means 212*a* and *b*. In alternative embodiments (not shown) backpack 100 and backpack 200 may comprise an upper chamber and a lower chamber. In those embodiments, torso belt 110 and hip belt 204 have a substantially similar configuration as torso belt 110 and hip belt 120, respectively. The upper chamber is generally aligned with torso belt 202 and the lower chamber is generally aligned with hip belt 110

In a preferred embodiment, the weight of backpack 100 and any objects carried within backpack 100 is carried on the torso of the user (i.e., at the waist 306 and hips). Specifically, torso belt 110 contacts and confers weight to the user's waist 3, while hip belt 120 contacts and confers weight to the user's hips. As described in further detail below, torso belt 110 and hip belt 120 are adjustable to selectively tighten and loosen (via longitudinal and/or angled tensioning belts) around the user's waist and hips, respectively. Accordingly, the backpack can be adjusted to change the distribution of weight of the backpack on the hips and shoulders and/or the backpack can be adjusted to fit different users.

Figure 2:
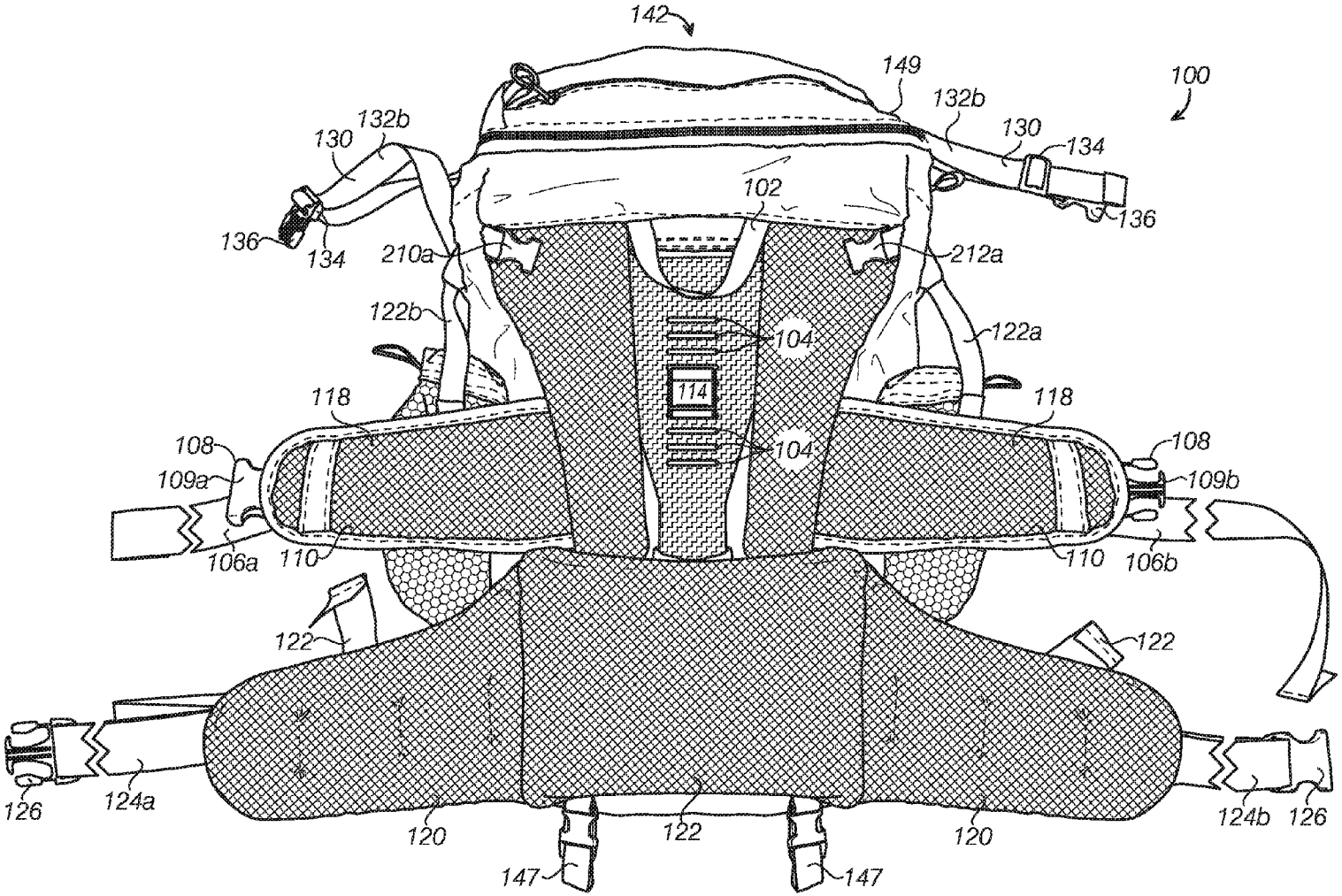
FIG. 2 is a rear elevation view of a first example of a backpack with removable and adjustable straps.
Figure 3:
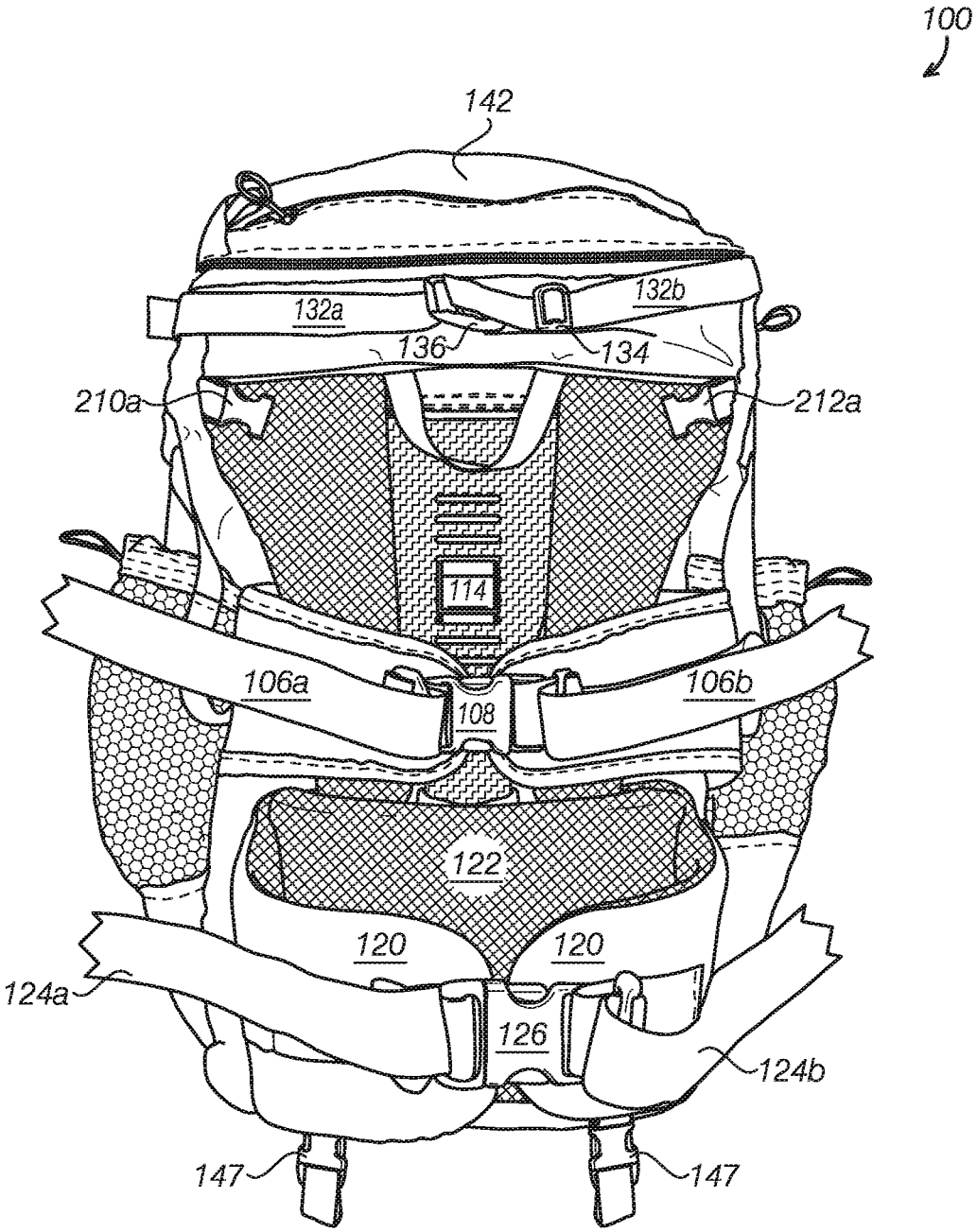
FIG. 3 is a rear elevation view of a first example of a backpack with removable straps and adjustable belts depicting one ways in which straps may be connected according to an embodiment of the backpack shown in FIG. 1.
Figure 6:
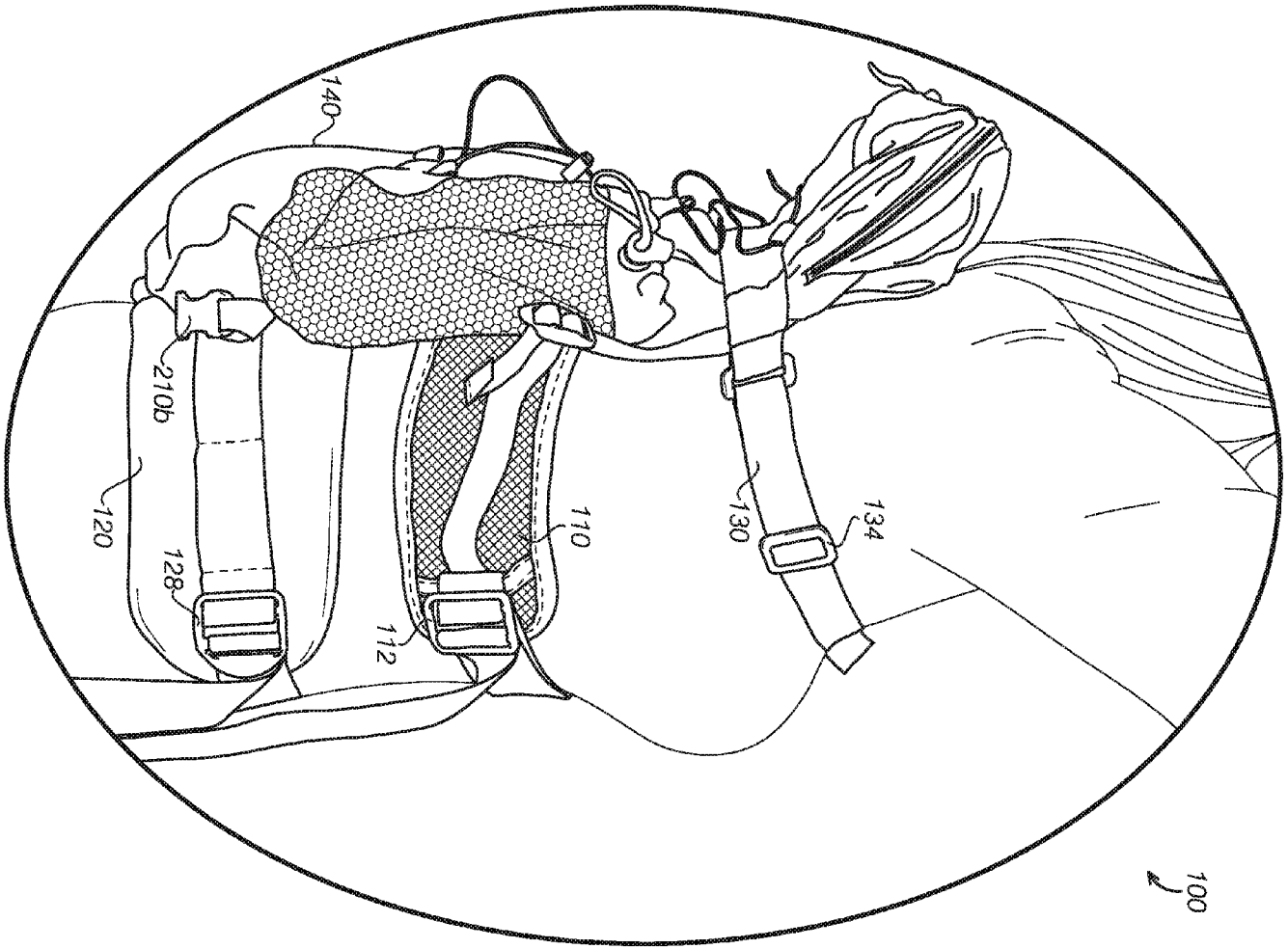
FIG. 6 is a side schematic view of a first example of a backpack with removable straps and adjustable belts according to one embodiment of the present invention.

Referring now to FIGS. 2 and 3, a rear elevation view of backpack 100 is shown. As shown in FIGS. 6 and 10, backpack 100 generally does not contact the user in the region of the cervical vertebrae. It will be appreciated that the shape, length, and/or orientation of the spines of various users may differ and therefore the components (e.g., the bag, the torso belt, the hip belt, etc.) of the backpack may contact and/or encompass a specific user in slightly differing regions. In some examples, the backpack can be custom built for the specific user, however, it should be understood that it is an object of the present invention to accommodate users with many different heights, weights, and body types.

Torso belt 110 (in combination with bag 140) is configured to encompass the torso of the user generally within the region of the T8-T12 region of the thoracic vertebrae of the spine, while hip belt 120 (in combination with bag 140) is configured to encompass the hips of the user generally within the L1-L5 region of the lumbar vertebrae of the spine. Similarly, top belt 130 (in combination with bag 140) is configured to encompass the chest of the user generally within the region of the T1-T7 region of the thoracic vertebrae of the spine. As can be seen in FIG. 2. Backpack 100 may further comprise band 102 affixed to bag 140 that permits the user to pick up backpack 100 and keep it upright.

As can be seen, torso belt 110 includes a padded body 118, which is comprised of a relatively thin cushioning material (e.g., foam padding etc.) enclosed by a sturdy, thinner material (e.g., nylon, canvas, or other synthetic fibers). The padded body is configured to cushion the torso belt against the user's body. In alternate examples, the padded body can instead be a generally sturdy elastic material (e.g., spandex, vinyl, nylon and the like) rather than a cushioning material.

Torso belt 110 includes first and second torso belt strap 106*a* and 106*b* that are selectively joinable via a torso belt coupling means 108. A torso belt tensioning means 112 (Shown in FIGS. 1 and 6) is affixed to the outer surface of a first and second torso belt strap 106*a* and *b*, respectively, generally along its longitudinal center. Torso belt tensioning means 112 comprises a mechanism for selectively tightening and loosening the longitudinal tensioning belt along the longitudinal axis of first torso belt strap 106*a* and second torso belt strap 106*b*. First and second torso belt straps 106*a* and *b* further comprise a torso belt coupling means 108 having a first and second torso belt coupling means partner 109*a* and *b*, respectively. First and second torso belt coupling means partner 109*a* or *b* may be fixed to either end of first or second torso belt strap 106*a* or *b* and as shown. In other examples, the coupling means partner can be attached to the padded body.

In a preferred embodiment, first and second torso belt strap 106*a* and 106*b* are affixed to the horizontal center of torso belt 110 as shown. Further, first and second torso belt strap 106*a* and 106*b* are substantially extendable and may be shortened or lengthened via torso belt tensioning means 112 to accommodate different users body types. Thus, first and second torso belt strap 106*a* and 106*b* may comprise a strip of durable material such as canvas or nylon while the torso belt strap tensioning means 112 tray comprise a slide, a loop, a clasp or other suitable mechanism for lengthen and shortening a strap. In the present example, torso belt coupling means 108 may comprise a side release buckle as shown. In alternative embodiments, torso belt coupling means 108 means may comprise double D-rings, hooks, buckles, snaps, carabiners, or any other suitable coupling means sufficient to accomplish the task of connecting the belts around the torso, hips, and chest of a user. Thus, FIG. 3 depicts hip belt 120, torso belt 110, and top belt 130 fastened as though they were attached around the body of the user.

First torso belt strap 106*a* further includes upper and lower angled tensioning belts 122*a* and 122*b* that may be affixed to either side bag 140 substantially between chest belt 130 and torso belt 110. Angled tensioning belts 122*a* and 122*b* each include a mechanism for selectively tightening and loosening the angled tensioning belts at an angle relative to the longitudinal axis of torso belt 110. In the present example, each of tensioning belts (e.g., longitudinal tensioning belts and angled tensioning belts) are selectively tightenable and loosenable is ladder locks. In other words, an end of each tensioning belt is insertable through a ladder lock and configured to be pulled to tighten the belt and loosened in an opposing direction by moving the end of the belt closer to the ladder lock. In alternate examples, the tensioning belts can be selectively tightenable and loosenable via a different mechanism (e.g., a double D-ring buckle, a conventional buckle, a clamp, etc.).

In a preferred embodiment, bag 140 may comprise a plurality of slots 104 located substantially in the center plane of the inner side of bag 140 as shown. Torso belt 110 may further comprise retainer 114. Retainer 114 comprises two tabs (not shown) that have complimentary dimensions to slot 104 such that the tabs may be removably inserted into slot 104. In this manner, the user may adjust the position of torso belt 110 higher or lower between hip belt 120 and top belt 130 by threading the tabs of retainer 114 through one of slot 104. In the present embodiment, retainer comprises two tabs of a hook and loop closure, however it should be understood that retainer may be any attaching means sufficient to secure hip belt 120 to bag 140.

Also shown in FIGS. 2 and 3 is hip belt 120. In a preferred embodiment, hip belt 120 is affixed to the lower portion of bag 140 further comprises a cushion 122 that is located substantially in the middle of hip belt 120. Hip belt 120 further comprises first and second hip belt strap 124*a* and 124*b* that are selectively joinable via a hip belt coupling means 126. In a preferred embodiment, first and second hip belt strap 124*a* and 124*b* are affixed to the horizontal center of hip belt 120 as shown. Further, first and second hip belt strap 124*a* and 124*b* are substantially extendable and may be shortened or lengthened to accommodate different users' body types. Thus, first and second hip belt strap 124*a* and 124*b* may comprise a strip of durable material such as canvas or nylon and include a hip belt strap tensioning means 128 (shown in FIG. 1) means for lengthening and shortening the strap such as a slide, a loop, a clasp or other suitable mechanism for lengthen and shortening a strap. In the present example, hip belt coupling means 126 may comprise a side release buckle as shown. In alternative embodiments, hip belt coupling 126 means may comprise double D-rings, hooks, buckles, snaps, carabiners, or any other suitable coupling means sufficient to accomplish the task of connecting hip belt 120 around the hips of a user.

A hip belt tensioning means 128 (Shown in FIGS. 1 and 6) is affixed to the outer surface of first and second hip belt strap 124*a* and *b*, respectively, generally along its longitudinal center. Hip belt tensioning means 128 is comprises a mechanism for selectively tightening and loosening the longitudinal tensioning belt along the longitudinal axis of first hip belt strap 124*a* and second hip belt strap 124*b*. First and second hip belt strap 124*a* and *b* further comprise a hip belt coupling means 126 having a first and second torso belt coupling means partner 125*a* and *b*, respectively. First and second hip belt coupling means partner 125*a* and *b* are fixed to either end of First and second hip belt strap 124*a* or *b*. In other examples (not shown), the coupling means partner can be attached to the padded body.

Figure 5:
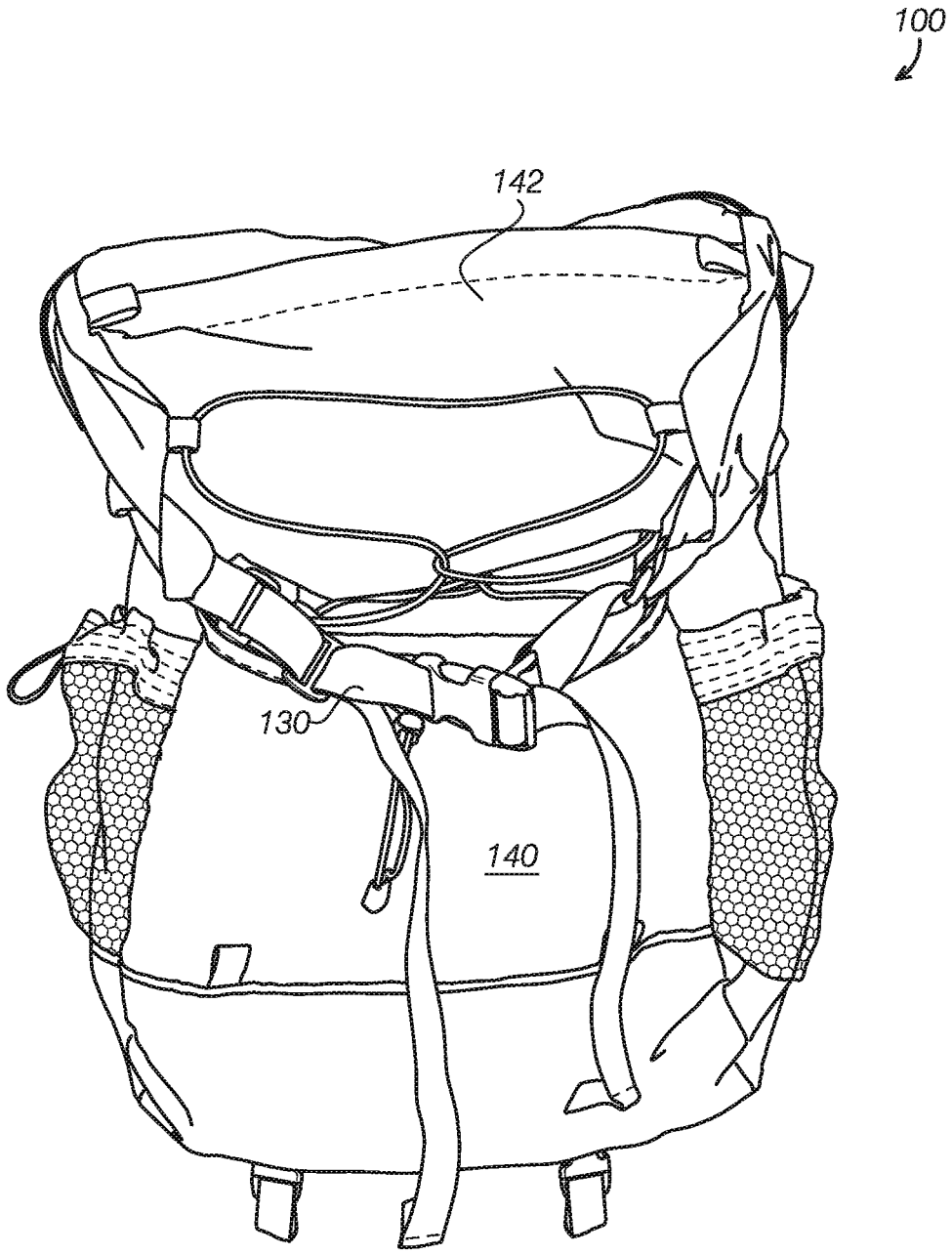
FIG. 5 is an alternate front elevation view of a first example of a backpack with removable straps and adjustable belts according to an alternative embodiment of the present invention.

Turning now to top belt 130, which includes first and second top belt strap 132*a* and 132*b* that are selectively joinable via a top belt coupling means 136. In a preferred embodiment, first and second top belt strap 132*a* and 132*b* are affixed to the horizontal center of top belt 130 as shown. Further, first and second for belt strap 132*a* and 132*b* are substantially extendable and may be shortened or lengthened to accommodate different users' body types. Thus, first and second top belt strap 132*a* and 132*b* may comprise a strip of durable material such as canvas or nylon and include a top belt strap tensioning means 134 means for lengthening and shortening the strap such as a slide, a loop, a clasp or other suitable mechanism for lengthen and shortening a strap. In the present example, torso belt coupling means 108 may comprise a side release buckle as shown. In alternative embodiments, torso belt coupling means 108 means may comprise double D-rings, hooks, buckles, snaps, carabiners, or any other suitable coupling means sufficient to accomplish the task of connecting top belt 130 around the chest of a user. In alternative embodiments, top belt 130 may be fastened around the front of bag 140 (as shown in FIG. 5).

Thus, FIG. 2 is an example of backpack 100 wherein the belts are not fastened and FIG. 3 is a view of backpack 100 that shows hip belt 120, top belt 130 and torso belt 110 as though they were connected around the body of a user. In this example, top belt 130 is connected around the user's chest. It is an object of the present invention that top belt 130 is capable of being attached around the front of compartment 142 instead of the chest of the user (shown in FIG. 5).

Bag 140 may further include a removable embedded rigid frame (not shown) that is configured to be abutted to and/or support the back of the user during wear of the backpack. The frame can be removable or non-removable according to the user's needs. The rigid frame may further comprises a plurality of frame slots (not shown) that are complementary to slot 104. Thus, when the user wishes to employ the rigid frame, she may still adjust the position of torso belt. The present figures depict rigid frame inserted into bag 140, however, it should be understood that the presence or absence of rigid frame does not bear of the adjustability of the straps, belts, or functionality of backpack 100 or backpack 200; its purpose is to provide internal structure if such structure is desired be the user. In a preferred embodiment, the frame comprises rigid material such as reinforced polymers or plastics, lightweight metals and metal alloys, rigid foams and foam composites, and other materials now known or later discovered, that are suitable to provide internal structure and support.

Thus, when backpack 100 is in use, the weight of backpack 100 and any objects carried within backpack 100 is carried on the torso of the user Specifically, torso belt 110 contacts and confers weight to the waist of a user, while hip belt 120 contacts and confers weight to the hips. As described above, torso belt 110 and hip belt 120 are adjustable to selectively tighten and loosen (via longitudinal and/or angled tensioning belts) around the waist and hip, respectively. Accordingly, the backpack can be adjusted to change the distribution of weight of the backpack on the hips and shoulders and/or the backpack can be adjusted to fit different users. Finally, backpack 100 supports an upright posture of the user. Accordingly, backpack 100 contributes to maintaining the spine of a user in alignment with desired curvatures of the spine for "good posture". Therefore, backpack 100 can improve the posture of a user during wearing of the backpack. Further, wearing of backpack 100 limits downward strain on the shoulders and spine of the user, which can occur during wearing of conventional backpacks.

Referring now to FIG. 4, an additional pouch, pouch 138 is attached to bag 140 via expansion attachment 147. As mentioned above, bag 140 comprises a plurality of expansion attachment 147 capable of removably receiving at least one additional pouch 138. In the present embodiment, expansion attachment 147 comprises a buckle and a strap, however it should be understood that attachment 147 may function to add components other than pouch 138, such as for example, a bed roll, two or more small bags, additional water bottles, or any other item that may be affixed to backpack 100 via a coupling arrangement. As mentioned above, bag 140 may comprise a plurality of hoop 148 for the purpose of hanging various accoutrement according to the user's needs. In the present example, a ring of keys is suspended from one of the plurality of hoop 148 via a carabiner, however it should be understood that the user may suspend from hoop 148 any item she wishes in any manner she wishes.

Referring mow to FIG. 5, an alternative embodiment of backpack 100 is shown wherein top belt 130 is attached around the front of compartment 142. It should be understood that this configuration does not affect the tensioning means or other functionality of top belt 130 or the remaining belts as discussed above. The user may choose this attachment configuration according to her needs and comfort.

FIG. 6 is an illustration of one embodiment of backpack 100 as worn by a user. In the present example, top belt 130 is attached around the chest of the user as shown. Torso belt 110 is attached around the waist of the user and hip belt 120 is attached around the hips of the user. Thus, in accordance with one of the objects of the present invention, backpack 100 is configured to function without the need of shoulder straps.

Figure 7:
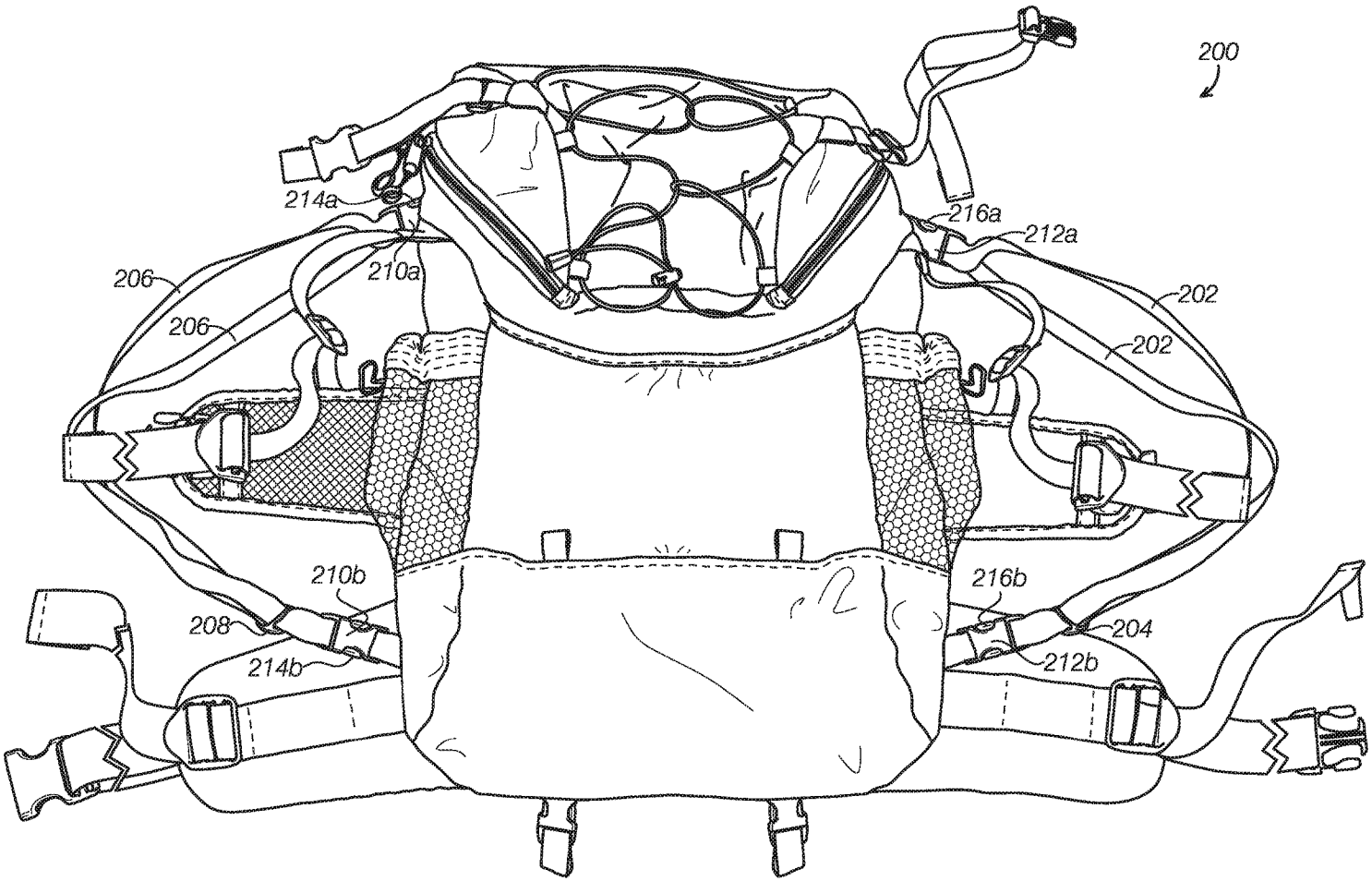
FIG. 7 is a front elevation view of a second example of a backpack with removable straps and adjustable belts.
Figure 8:
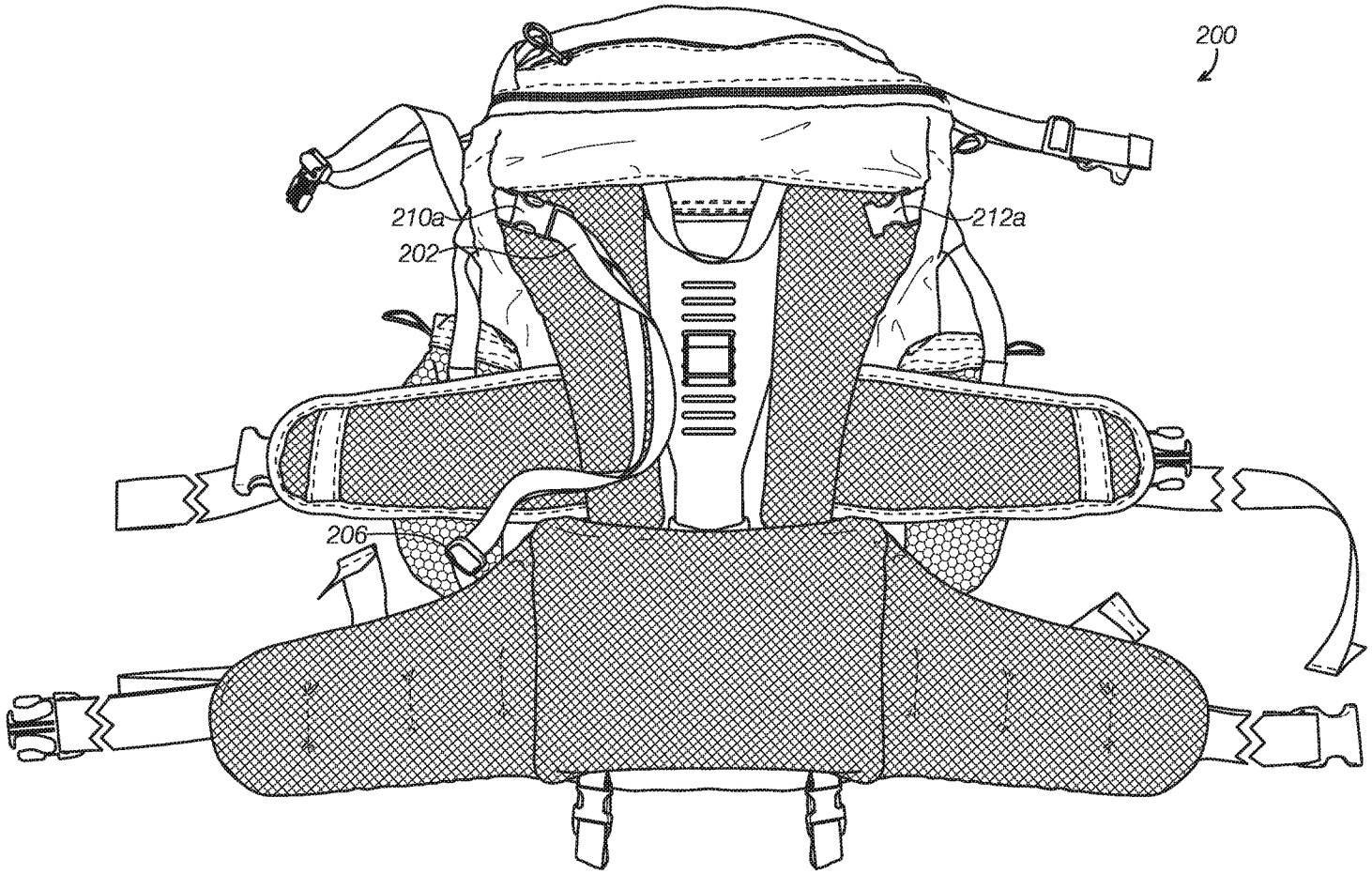
FIG. 8 is a rear elevation view of a second example of a backpack with removable straps and adjustable belts.

A second example of a backpack with removable and adjustable straps, backpack 200 is shown in FIGS. 7 and 8. Backpack 200 includes many similar or identical features to backpack 100. Thus, for the sake of brevity, each feature of backpack 200 will not be redundantly explained. Rather, key distinctions between backpack 200 and backpack 100 will be described in detail and the reader should reference the discussion above for features substantially similar between the two backpacks.

In contrast to backpack 100, backpack 200 may comprise removable shoulder straps. The shoulder straps comprise a right shoulder strap 202 having a right shoulder strap tensioning means 204 and a left shoulder strap 206 having a left shoulder strap tensioning means 208. In a preferred embodiment, the shoulder straps comprise a sturdy material such as nylon, canvas, or other suitable material. As shown, the shoulder straps are comprised of a strip of the sturdy material, and in the present configuration, are of a sufficient length to permit the user to determine the desired. In this configuration, then, the shoulder straps are capable of being shorthand or lengthened via the left and right shoulder extending means, 204 and 208, respectively.

Right shoulder strap 202 includes a pair of right shoulder strap coupling means 210*a* and *b*, respectively, and left shoulder strap 206 includes a pair of left shoulder strap coupling means 212*a* and *b*, respectively. As can be seen, the left pair of shoulder strap connectors 214*a* and *b*, respectively, connect to the left pair of shoulder strap coupling means 210*a* and *b*, respectively. Similarly, the right pair of shoulder strap connectors 212*a* and 212*b* connect to the right pair of shoulder strap coupling means 216*a* and *b*. The present figure shows one of said pair of shoulder strap connectors, 214*b* connected to one of left pair of shoulder strap coupling means 210*b* on the lower left side of bag 140, and the other of left pair of shoulder connectors 214*a* connected to the other of the left pair of shoulder strap coupling means 210*a* on the upper left side of bag 140. Similarly, FIG. 7 also shows the second of said pair of shoulder strap connectors, 212*b* connected to one of left pair of shoulder strap coupling means 216*b* on the lower left side of bag 140, and the other of left pair of shoulder connectors 212*a* connected to the other of the left pair of shoulder strap coupling means 216*a* on the upper left side of bag 140.

It should be understood that it is an object of the present invention for the pair of left shoulder strap coupling means and connectors, and the right shoulder strap coupling means and connectors are interchangeable. Further, the coupling means an connectors are shown as side release buckles, however it is an object of the present invention that alternative suitable connectors and coupling means may be employed, including but not limited to snaps, buckles, ties, hook-and-loop fasteners, or any coupling mechanism sufficient to accomplish attaching left shoulder strap 202 and right shoulder strip 206 to bag 140. Finally, it is a further object of the present embodiment that a single or both shoulder straps may be employed. The present figure depicts both left and right shoulder straps (202, 206) attached to bag 140 by way of example only. FIG. 8, then, by way of example depicts an embodiment of backpack 200 wherein only left shoulder strap 202 is attached.

As alluded to above, it is an object of the present invention that either shoulder strap may be employed. It will be appreciated that the longitudinal tensioning belts are configured to tighten the torso and hip belts around the body of the user, while the angled tensioning belts are configured to alter/adjust weight distribution on the torso and hip belts. It will be further appreciated that the second members of the torso and hip belts can have a substantially similar configuration. Finally, it is an object of the present invention that first pair of shoulder strap coupling means 210*a* and *b* and second pair of shoulder strap coupling means 212*a* and *b* are configured to removably receive optional shoulder straps (shown and described in further detail below). In alternative embodiments, if the user does not wish to employ shoulder straps, she may use the shoulder strap coupling means to attach additional items to backpack 100, or she may simply let them remain unused. In the present embodiment, the user has opted to let the shoulder strap coupling means dangle unused as shown.

Figure 9:
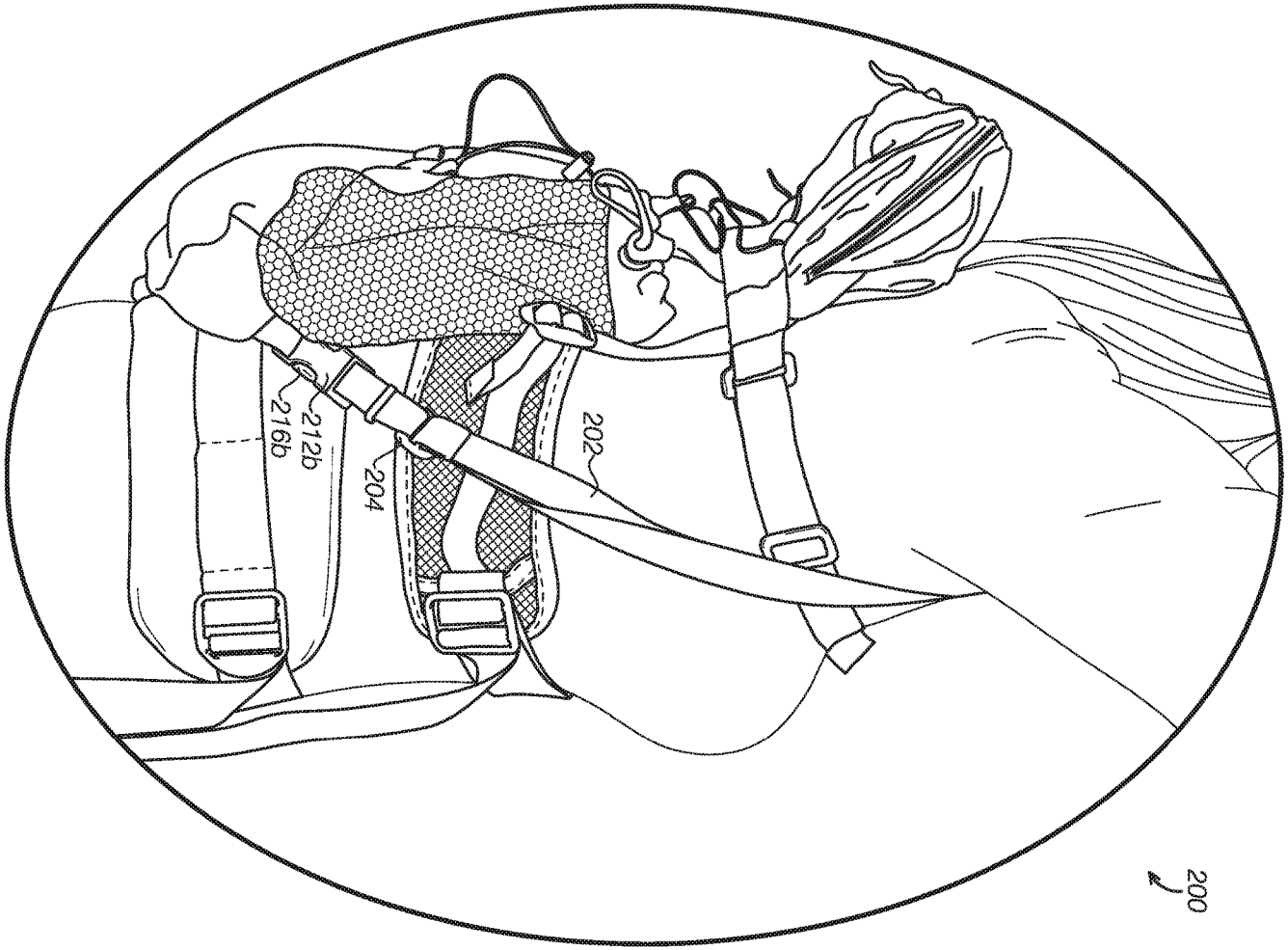
FIG. 9 is a side schematic view of a first example of a backpack with removable straps and adjustable belts according to an alternative embodiment of the present invention.

Referring finally to FIG. 9, an alternative view of backpack 200 is shown being worn by a user. As depicted in FIGS. 5-8, the shoulders of are free of weight bearing structures and/or features of backpack 100. Further, as shown in FIGS. 6 and 9, the arms of a user can be extended and/or lifted limited restraint by backpack 100.

As can be seen in FIG. 9, backpack 200 supports an upright posture of the user. Accordingly, backpack 200 contributes to maintaining the spine of a user in alignment with desired curvatures of the spine for "good posture". Therefore, backpack 100 can improve the posture of a user during wearing of the backpack. Further, wearing of backpack 200 limits downward strain on the shoulders and spine of the user, which can occur during wearing of conventional backpacks. In the present embodiment, the user may opt to attach one or both shoulder straps for additional support. It should be understood that the presence or absence of the shoulder straps does not interfere with the functionality, purpose, or effectiveness of the components of backpack 200.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal scope to the original claims, are to be considered within the subject matter of the inventions described herein.

The invention claimed is:

1. A shoulder-strapless backpack having a rigid internal frame wherein the weight of the contents of the backpack is distributed among a plurality of belts, the backpack comprising:

a pouch configured to removably receive the rigid frame and for wearing against the back of a user wherein the pouch is configured to contain items of varying shapes, sizes, and weights;

a removable, adjustable torso belt having a coupling means, a torso belt left side, a torso belt right side, and a torso belt middle, the torso belt being configured to removably attach around the torso of a user;

an adjustable hip belt having a hip belt left side, a hip belt right side, and a hip belt middle, the adjustable hip belt further comprising a coupling means and being configured to removably attach around the hips of a user;

an adjustable chest belt attached to the pouch having a chest belt left side and a chest belt right side, the adjustable chest belt further comprising a coupling means and configured to removably attach around the chest of the user;

a plurality of adjustable straps;

a plurality of releasable connectors; and a plurality of pockets.

2. The backpack of claim 1 wherein the rigid internal frame further comprises a plurality of lateral slots, a frame top, a frame bottom, and a frame middle and wherein the frame bottom is positioned substantially over the sacral portion of the user's spine, the frame middle is positioned substantially over the lumbar portion of the user's spine, and the frame top is positioned between the thoracic and cervical portions of the user's spine.

3. The backpack of claim 1 wherein the pouch further comprises a plurality of compartments to enable separation of items placed inside the pouch.

4. The backpack of claim 1 wherein the adjustable torso belt further comprises a cushion for lumbar support and wherein the torso belt middle rests against the frame middle, wherein the torso belt left side removably couples to the torso belt right side, and wherein said adjustable torso belt supports a portion of the weight of items contained in the pouch.

5. The backpack of claim 2, wherein the adjustable torso belt further comprises a second coupling means near the torso belt middle and wherein the adjustable torso belt is capable of being removably positioned in different locations by securing the torso belt coupling means through the lateral slots.

6. The backpack of claim 1 wherein the adjustable torso belt is configured to be the predominant load bearing belt.

7. The backpack of claim 1 wherein the adjustable hip belt further comprises at least two longitudinally extending support members, the first of said two longitudinally attached to the hip belt left side and extending upward to attach to the pouch above the top of rigid internal frame and the second of said at least two longitudinally extending support members attaching longitudinally attached on the hip belt left right side pouch and extending upward to attach to the pouch above the top of rigid internal frame.

8. The backpack of claim 1 wherein the hip belt middle rests against the frame bottom and further comprises a cushion for lumbar support, the adjustable hip belt being configured to removably attach around the hips of a user and wherein the hip belt supports the weight of items stored in the pouch.

9. The backpack of claim 1 wherein the adjustable hip belt further comprises pliant material arranged in differing densities according to its position in relation to the rigid frame.

10. The backpack of claim 1 wherein the adjustable chest belt left side removably couples to the chest belt right side around the front of the pouch and wherein said chest belt supports a portion of the weight of items stored in the pouch.

11. The backpack of claim 1, wherein the adjustable chest belt comprises elastic.

12. The backpack of claim 1 further comprising a webbed portion configured to removably receive items for storage and transport and a plurality of pliant support members for removably attaching equipment.

13. The backpack of claim 1, wherein at least one of the said plurality of releasable connectors is configured to removably attach at least one additional pouch to the backpack.

14. The backpack of claim 1, wherein the said plurality of pockets further comprises at least one pocket configured to removably receive a water bottle.

15. The backpack of claim 1 wherein the rigid internal frame is adjustable and removably attached the pouch.

16. A backpack having a rigid internal frame wherein the weight of the contents of the backpack is distributed among a plurality of belts, the backpack comprising:

a pouch configured to removably receive the rigid frame and for wearing against the back of a user wherein the pouch is configured to contain items of varying shapes, sizes, and weights;

a removable, adjustable torso belt, having a coupling means, a torso belt left side, a torso belt right side, and a torso belt middle, the torso belt further comprising a coupling means and being configured to removably attach around the torso of a user;

an adjustable hip belt having a hip belt left side, a hip belt right side, and a hip belt middle, the adjustable hip belt further comprising a coupling means and being configured to removably attach around the hips of a user;

an adjustable chest belt attached to the pouch having a chest belt left side and a chest belt right side, the adjustable chest belt farther comprising a coupling means and configured to removably attach around the chest of the user;

at least one removable shoulder strap having a first end and a second end;

a plurality of adjustable straps;

a plurality of releasable connectors; and a plurality of pockets.

17. The backpack of claim 16 wherein the first end of the said at least one removable shoulder strap is removably attached to the adjustable hip belt and the second end is removably attached to the pouch.

18. The backpack of claim 16 wherein:

the adjustable torso belt further comprises a cushion for lumbar support, said adjustable torso belt being configured to removably attach around the waist of a user;

the adjustable hip belt further comprises at least two longitudinally extending support members, the first of said two longitudinally extending support members attaching to the top of the pouch at the distal end and the adjustable hip left side, and the second of said at least two longitudinally extending support members attaching to the top of the pouch at the distal end and the adjustable hip right side; and the hip belt further comprises a cushion for lumbar support that rests against the frame bottom and wherein the hip belt left side removably couples to the hip belt right side, the adjustable hip belt being configured to removably attach around the hips of a user and wherein the hip belt supports the weight of items stored in the pouch.

19. The backpack of claim 16, wherein the chest belt is configured to secure the topmost portion of said pouch;

wherein the torso belt is capable of being positioned in different locations on the frame to accommodate users of different heights; and wherein at least one of the said plurality of releasable connectors is configured to removably attach at least one additional pouch to the backpack.

* * * * *